US009597246B2

(12) United States Patent
Rapoport

(10) Patent No.: US 9,597,246 B2
(45) **Date of Patent: *Mar. 21, 2017**

(54) PREMATURE NEONATE CLOSED LIFE SUPPORT SYSTEM

(75) Inventor: Uri Rapoport, Moshav Ben Shemen (IL)

(73) Assignee: Aspect Imaging Ltd., Shoham (IL)

( * ) Notice: Subject to any disclaimer, the term of this patent is extended or adjusted under 35 U.S.C. 154(b) by 293 days.

This patent is subject to a terminal disclaimer.

(21) Appl. No.: 13/233,515

(22) Filed: Sep. 15, 2011

(65) Prior Publication Data

US 2012/0071745 A1 Mar. 22, 2012

Related U.S. Application Data

(60) Provisional application No. 61/383,349, filed on Sep. 16, 2010.

(51) Int. Cl.
*A61G 11/00* (2006.01)

(52) U.S. Cl.
CPC ..... *A61G 11/00* (2013.01); *A61G 11/009* (2013.01)

(58) Field of Classification Search
CPC .... A61G 11/009; A61G 11/00; A61G 11/005; A61G 11/006; A61G 2203/80; A61G 2210/50
USPC ..... 600/22, 21
See application file for complete search history.

(56) References Cited

U.S. PATENT DOCUMENTS 3,470,866 A * 10/1969 Gittelson ..... 600/22
4,712,263 A * 12/1987 Pronzinski ..... 5/658
4,750,474 A * 6/1988 Dukhan et al. ..... 600/22
5,800,335 A 9/1998 Koch et al.
5,943,716 A * 8/1999 Chu ..... A47C 29/003 5/423
6,228,106 B1 * 5/2001 Simbruner et al. ..... 607/96
6,611,702 B2 8/2003 Rohling et al.
(Continued)

OTHER PUBLICATIONS

Aspect Imaging Ltd., "Method for Providing High Resolution, High Contrast Fused MRI Images", co-pending U.S. Appl. No. 13/877,553, filed Apr. 3, 2013.

(Continued)

*Primary Examiner* — Catherine B Kuhlman
*Assistant Examiner* — Shannon McBride
(74) *Attorney, Agent, or Firm* — Pearl Cohen Zedek Latzer Baratz LLP

(57) ABSTRACT

A premature neonate closed life support system (NCLSS) including: at least one chamber confining a cradle-like neonate support (CLNS) having suitable dimensions and geometric-configuration for accommodating at least one premature neonate having at least two operational configurations, said operational configurations comprising: a first operational OPEN configuration whereby said CLNS is adapted to couple said neonate to at least one life supporting system by means of at least one life supporting coupling line, prior to positioning said CLNS in a medical device; and a second operational air-tight CLOSED configuration whereby said neonate remains continuously coupled to said at least one life supporting system by means of at least one life supporting coupling line, when positioning said CLNS within said medical device. The OPEN and CLOSED configurations are reversible.

9 Claims, 3 Drawing Sheets

(56) References Cited

U.S. PATENT DOCUMENTS

| | | | | |
|---|---|---|---|---|
| 7,278,962 | B2 | 10/2007 | Lonneker-Lammers | |
| 8,851,018 | B2 | 10/2014 | Rapoport et al. | |
| 8,896,310 | B2 | 11/2014 | Rapoport | |
| 2004/0236174 | A1* | 11/2004 | Boone et al. | 600/21 |
| 2005/0113668 | A1* | 5/2005 | Srinivasan | 600/411 |
| 2007/0232894 | A1 | 10/2007 | Feenan | |
| 2011/0162652 | A1 | 7/2011 | Rapoport | |
| 2011/0186049 | A1 | 8/2011 | Rapoport | |
| 2011/0234347 | A1 | 9/2011 | Rapoport | |
| 2011/0304333 | A1 | 12/2011 | Rapoport | |
| 2012/0071745 | A1 | 3/2012 | Rapoport | |
| 2012/0073511 | A1 | 3/2012 | Rapoport et al. | |
| 2012/0077707 | A1 | 3/2012 | Rapoport | |
| 2012/0119742 | A1 | 5/2012 | Rapoport | |
| 2013/0079624 | A1 | 3/2013 | Rapoport | |
| 2013/0109956 | A1 | 5/2013 | Rapoport | |
| 2013/0237803 | A1 | 9/2013 | Rapoport | |
| 2013/0328559 | A1 | 12/2013 | Rapoport | |
| 2013/0328560 | A1 | 12/2013 | Rapoport | |
| 2013/0328563 | A1 | 12/2013 | Rapoport | |
| 2014/0050827 | A1 | 2/2014 | Rapoport | |
| 2014/0051973 | A1 | 2/2014 | Rapoport et al. | |
| 2014/0051974 | A1 | 2/2014 | Rapoport et al. | |
| 2014/0051976 | A1 | 2/2014 | Rapoport et al. | |
| 2014/0099010 | A1 | 4/2014 | Rapoport | |
| 2014/0103927 | A1 | 4/2014 | Rapoport | |
| 2014/0117989 | A1 | 5/2014 | Rapoport | |
| 2014/0128725 | A1 | 5/2014 | Rapoport | |
| 2014/0139216 | A1 | 5/2014 | Rapoport | |
| 2014/0142914 | A1 | 5/2014 | Rapoport | |
| 2014/0152302 | A1 | 6/2014 | Rapoport et al. | |
| 2014/0152310 | A1 | 6/2014 | Rapoport | |
| 2014/0158062 | A1 | 6/2014 | Rapoport et al. | |
| 2014/0230850 | A1 | 8/2014 | Rapoport | |
| 2014/0257081 | A1 | 9/2014 | Rapoport | |
| 2014/0266203 | A1 | 9/2014 | Rapoport | |
| 2014/0300358 | A1 | 10/2014 | Rapoport | |
| 2014/0378821 | A1 | 12/2014 | Rapoport et al. | |
| 2014/0378825 | A1 | 12/2014 | Rapoport et al. | |
| 2015/0065788 | A1 | 3/2015 | Rapoport | |

OTHER PUBLICATIONS

Aspect Imaging Ltd., "Method for Manipulating the MRI's Protocol of Pulse Sequences", co-pending U.S. Appl. No. 14/070,695, filed Nov. 4, 2013.

Aspect Imaging Ltd., "Shutting Assembly for Closing an Entrance of an MRI Device", co-pending U.S. App. No. 14/540,163, filed Nov. 13, 2014.

Aspect Imaging Ltd, "MRI-Incubator's Closure Assembly", co-pending U.S. Appl. No. 14/539,442, filed Nov. 12, 2014.

Aspect Imaging Ltd., "Cage in an MRD with a Fastening/Attenuating System", co-pending U.S. Appl. No. 14/527,950, filed Oct. 30, 2014.

Rapoport, Uri, "RF Shielding Conduit in an MRI Closure Assembly", co-pending U.S. Appl. No. 14/574,785, filed Dec. 18, 2014.

Aspect Imaging Ltd., "System and Method for Generating Invasively Hyperpolarized Images", co-pending U.S. Appl. No. 14/556,682, filed Dec. 1, 2014.

Aspect Imaging Ltd., "System and Method for Generating Invasively Hyperpolarized Images", co-pending U.S. Appl. No. 14/556,654, filed Dec. 1, 2014.

Aspect Imaging Ltd., "MRI with Magnet Assembly Adapted for Convenient Scanning of Laboratory Animals with Automated RF Tuning Unit", co-pending U.S. Appl. No. 14/581,266, filed Dec. 23, 2014.

Aspect Imaging Ltd., "Chamber for Housing Animals During Anaesthetic Procedures", co-pending U.S. Appl. No. 14/537,266, filed Nov. 10, 2014.

Aspect Imaging Ltd., "RF Automated Tuning System Used in a Magnetic Resonance Device and Methods Thereof", co-pending U.S. Appl. No. 14/588,741, filed Jan. 2, 2015.

Aspect Imaging Ltd., "Means for Operating an MRI Device Within a RF-Magnetic Environment", co-pending U.S. Appl. No. 14/596,320, filed Jan. 14, 2015.

Aspect Imaging Ltd., "Means and Method for Operating an MRI Device Within a RF-Magnetic Environment", co-pending U.S. Appl. No. 14/596,329, filed Jan. 14, 2015.

Aspect Imaging Ltd., "CT/MRI Integrated System for the Diagnosis of Acute Strokes and Methods Thereof", co-pending U.S. Appl. No. 14/598,517, filed Jan. 16, 2015.

Aspect Imaging Ltd., "Mechanical Clutch for MRI", co-pending U.S. Appl. No. 14/611,379, filed Feb. 2, 2015.

Aspect Imaging Ltd., "Foamed Patient Transport Incubator", co-pending U.S. Appl. No. 14/531,289, filed Nov. 3, 2014.

Aspect Imaging Ltd., "Incubator Deployable Multi-Functional Panel", co-pending U.S. Appl. No. 14/619,557, filed Feb. 11, 2015.

Aspect Imaging Ltd., "MRI Thermo-Isolating Jacket", co-pending U.S. Appl. No. 14/623,039, filed Feb. 16, 2015.

Aspect Imaging Ltd., "MRI RF Shielding Jacket", co-pending U.S. Appl. No. 14/623,051, filed Feb. 16, 2015.

Aspect Imaging Ltd., "Capsule for a Pneumatic Sample Feedway", co-pending U.S. Appl. No. 14/626,391, filed Feb. 19, 2015.

Aspect Imaging Ltd., "Incubator's Canopy with Sensor Dependent Variably Transparent Walls and Methods for Dimming Lights Thereof", co-pending U.S. Appl. No. 14/453,909, filed Aug. 7, 2014.

Aspect Imaging Ltd., "Temperature-Controlled Exchangeable NMR Probe Cassette and Methods Thereof", co pending U.S. Appl. No. 14/504,890, filed Oct. 2, 2014.

Aspect Imaging Ltd., "NMR Extractable Probe Cassette Means and Methods Thereof", co-pending U.S. Appl. No. 14/504,907, filed Oct. 2, 2014.

* cited by examiner

PREMATURE NEONATE CLOSED LIFE SUPPORT SYSTEM

CROSS-REFERENCE TO RELATED APPLICATIONS

This application is claims priority from U.S. Provisional Patent Application No. 61/383,349, filed Sep. 16, 2010, which is hereby incorporated by reference.

FIELD OF THE INVENTION

The present invention generally pertains to a catheter with a premature neonate closed life support system for use in medical devices, especially a portable MRD device

BACKGROUND OF THE INVENTION

Neonates are typically accommodated in incubators in a dedicated premature baby ward or department of a hospital. The incubators are typically not robust and the general health of the neonate is often compromised. Each disturbance or perturbation of the neonate can have deleterious consequences. Nevertheless it is often essential to transfer the neonate to MRI devices and rooms located at a distance from the premature baby ward. This entails disconnecting the neonate from life supporting connection lines and systems and then reconnecting the life supporting connection lines and systems. Such activities may be dangerous to the neonate patients.

Various patent documents describe a variety of incubators especially designed for used in conjunction with an MRI device. These prior art incubators a temporary disconnection of the neonate from the life supporting lines and systems. Hence, for example, US Published Patent Application No. 2007/0232894 to Feenan provides an extendable carriage configured to shuttle between the neonate incubator and the magnetic resonance incubator system. U.S. Pat. No. 6,611,702 to Rohling provides an enclosure coupled to life support mechanisms and adapted to maintain a selected environment. An RF coil is included within the enclosure. U.S. Pat. No. 5,800,335 to Koch provides a specialized incubator for use in tomography, as does U.S. Pat. No. 7,278,962 to Lonneker-Lammers.

None of the above prior art systems provide a solution for transferring a neonate from an incubator to the MRI device. Providing devices and methods for transferring a neonate, whilst avoiding dangerous exposure of the neonate to the external environment and without endangering the neonate by disconnection of the life supporting connection lines, would fulfill a long felt need.

SUMMARY OF THE INVENTION

It is thus one object of the invention to disclose a premature neonate closed life support system (NCLSS). The NCLSS comprises at least one chamber confining a cradle-like neonate support (CLNS) sized and shaped for accommodating at least one premature neonate and reversibly transformable, from an OPEN configuration, in which the CLNS is adapted to couple the neonate to at least one life supporting connection line life and supporting systems to an air-tight CLOSED configuration, in which the CLNS is suitably placed within a medical device. The transformation of the chamber from the OPEN configuration to the air-tight CLOSED configuration is provided while the neonate is continuously coupled to the at least one life supporting connection line and life supporting systems.

It is another object of the invention to disclose an NCLSS as defined above, wherein the medical device is an MRD, and wherein the CLNS is constructed from magnetic field permeable materials It is another object of the invention to disclose an NCLSS as defined above, wherein the at least one life supporting connection line and life supporting systems are one or more members of a group consisting of fluids, air condition inlet and outlets; anesthetic gas; oxygen; liquids; water; food supply, connectors and applicators of medical devices and monitors thereof, or any combination thereof.

It is another object of the invention to disclose an NCLSS as defined above, wherein the cradle-like neonate support is constructed from a plurality of maneuverable flaps.

It is another object of the invention to disclose an NCLSS as defined above, wherein the NCLSS comprises a CLNS, reversibly transformable from an OPEN CONFIGURATION, locatable within a commercially available neonate incubator to a CLOSED configuration defined as a continuous life supporting capsule locatable within a commercially available MRD device. The CLNS is air-tight and fluidly-sealable and constructed from magnetic field permeable materials, the CLNS in its OPEN configuration is configured to maintain life support coupling of the neonate in the CLOSED configuration, wherein the relocation of the neonate from the cradle of the OPEN CLNS within the incubator to the air-tight CLOSED CLNS within the MRD, and vice versa, is provided by a single step insertion without decoupling or recoupling of the CLNS with life supporting connection lines.

It is still another object of the invention to disclose a method of transferring a neonate from an incubator to a medical device, such as an MRI device, without decoupling the neonate from the life supporting connection lines and life supporting systems. The method comprises, inter alia, steps of providing at least one premature neonate closed life support system (NCLSS) with at least one chamber comprising a cradle-like neonate support (CLNS); providing the CLNS, by means of size and shape for accommodating the at least one premature neonate; placing the neonate within or on top of the CLNS; transforming the CLNS from an OPEN configuration, in which the CLNS is adapted to couple the neonate with at least one life supporting connection line life and supporting systems to an air-tight CLOSED configuration in which the chamber is suitably placed within a medical device, such as an MRD; and transferring the neonate, placed within the CLOSED configuration CLNS to the medical device such that that the transformation of the CLNS from the OPEN configuration to the air-tight CLOSED configuration is provided while the neonate is continuously coupled to the at least one life supporting connection line and life supporting systems.

It is another object of the invention to disclose a method as defined above, wherein the method additionally comprises the steps of (i) providing the air-tight CLOSED configuration to be permeable to magnetic fields; and (ii) providing the CLNS suitable to be placed within an MRD device.

BRIEF DESCRIPTION OF THE DRAWINGS

The present invention will be more readily understood from the detailed description of embodiments thereof made in conjunction with the accompanying drawings of which.

DETAILED DESCRIPTION OF THE PREFERRED EMBODIMENTS

The following description is provided, alongside all chapters of the present invention, to enable any person skilled in the art to make use of the invention and sets forth the best modes contemplated by the inventor of carrying out this invention. Various modifications, however, will remain apparent to those skilled in the art, since the generic principles of the present invention have been defined specifically to provide a premature neonate closed life support system and methods thereof.

The term 'magnetic resonance device' (MRD) specifically applies hereinafter to any Magnetic Resonance Imaging (MRI) device, any Nuclear Magnetic Resonance (NMR) spectroscope, any Electron Spin Resonance (ESR) spectroscope, any Nuclear Quadruple Resonance (NQR) or any combination thereof. The MRD hereby disclosed is optionally a portable MRI device, such as the ASPECT-MR Ltd commercially available devices, or a commercially available non-portable device. Moreover, the term 'MRD' generally refers to any non-incubator medical devices, at least temporary accommodating the neonate.

As used herein, the term "neonate" generally refers to any object or living creature, such as human being or other mammal and preferably refers to babies.

As used herein, the term "plurality" refers in a non-limiting manner to any integer equal or greater than 1.

The term 'about' refers herein to a value of ±25% of the defined measure.

Figure 1:
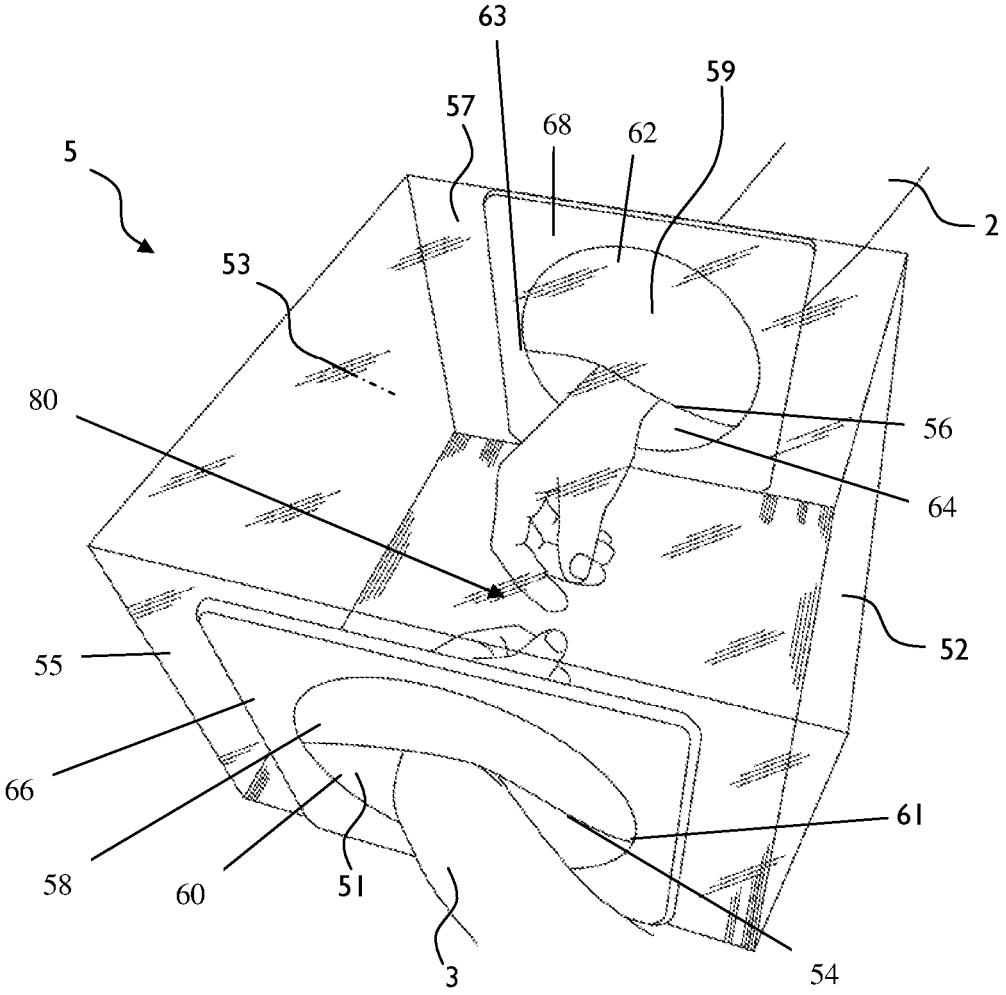
FIG. 1. is a schematic, not to scale illustration of a neonate's incubator, according to an embodiment of the present invention.

Reference is now made to FIG. 1, schematically illustrating in an out-of-scale manner a neonate's incubator. More specifically, an incubator 5 presented in FIG. 1 is provided useful by means of size, shape and dimensions to at least temporarily accommodate in its inner air tight sealed volume 53 a neonate under medical care, e.g., anesthetics, imaging or other diagnostics or treatment. The incubator 5 comprises, inter alia, operator hand access ports, 51 and 59, for operator hands 3 and 2, respectively. Each one of the ports 51 and 59 comprises a port aperture 54 and 56, located on incubator walls 55 and 57, respectively, and at least two pairs of flexible non-resilient lightweight sealing gas-tight flaps (SFs) (58 and 60) and (62 and 64), disposed within the same plane of the port apertures 54 and 56, respectively, in an overlapping manner, thereby entirely enclosing the respective port apertures 54 and 56. Each pair of the SFs (58 and 60) and (62 and 64) is attached to port aperture edges 61 and 63, respectively and incubator supporting flanges 66 and 68, respectively. The incubator flanges 66 and 68 are attached to the incubator walls 55 and 57 and each member of the pair of flaps (58 and 60) and (62 and 64) are in an overlapping arrangement, as shown in FIG. 1. The members of each pair of flaps (58 and 60) and (62 and 64) are stretched across each respective port aperture 54 and 56 thereby enclosing and defining an interior access zone 80, disposed within the same plane of the port aperture and characterized solely by the port flanges 66 and 68 of each pair of SFs (58 and 60) and (62 and 64).

The incubator 5 has a plurality of walls, one of which is wall 52.

Figure 2:
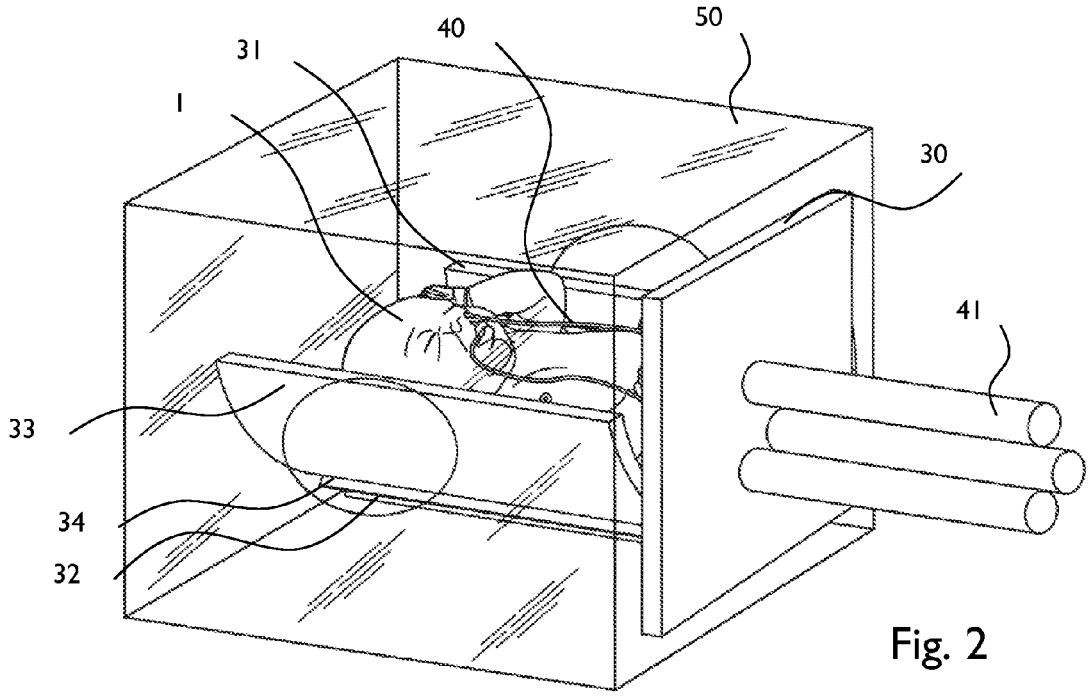
FIG. 2. is a schematic, not to scale illustration of a neonate's incubator showing the location of the premature neonate within the incubator, according to an embodiment of the present invention.

Reference is now made to FIG. 2, schematically illustrating in an out-of-scale manner the neonate's incubator 50, wherein the premature neonate closed life support system (NCLSS) is located within the inner volume of the incubator 50. The NCLSS system comprises, inter alia, at least one chamber comprising a cradle-like neonate support (32) sized and shaped for accommodating at least one premature neonate 1. CLNS is reversibly transformable from an OPEN configuration, as presented in FIG. 2, in which the CLNS is adapted to couple the neonate with at least one life supporting connection line, prior to insertion into a medical device, such as an MRD; to an air tight CLOSED configuration as presented in FIG. 3, in which the chamber is permeable to magnetic fields and suitable to be set within said MRD device.

According to one embodiment of the invention, and in a non-limiting manner, the CLNS is constructed by a plurality of maneuverable flaps, flaps 31-34, wherein in the OPEN configuration, upper flap 33 has a curved cradle-like shape. The neonate 1 is conveniently and safely positioned on top of flap 33. Other curved flaps, namely 32-34, slide beneath flap 31. The CLNS further comprises side wall 30 which is adapted to fit wall 52 as presented in FIG. 1, which is the planar support for communicating a plurality of at least one life supporting connection lines positioned within the incubator, namely lines 40, with those positioned outside the incubator (41). The neonate 1 thus is maintained and treated within incubator 50 or in any commercially available incubator.

Figure 3:
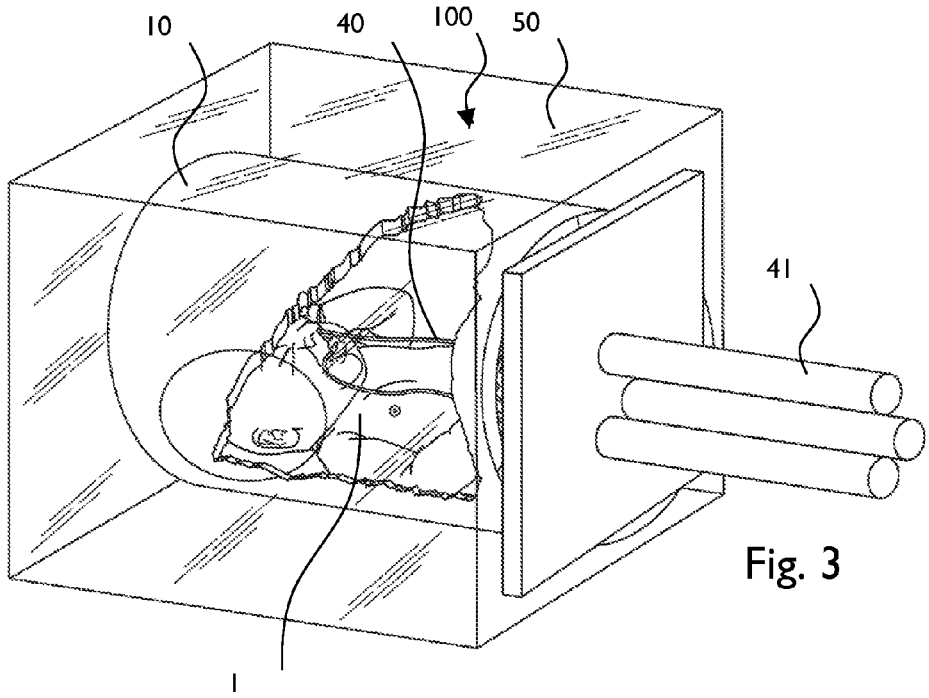
FIG. 3. is a schematic, not to scale illustration of a neonate's incubator of FIG. 2, wherein the premature neonate closed life support system (NCLSS) is located within the inner volume of the incubator, according to an embodiment of the present invention.

Reference is now made to FIG. 3, schematically illustrating in an out-of-scale manner neonate's incubator 50, wherein all flaps are closed to form air tight capsule 100 in the CLOSE configuration. Neonate 1 is enveloped within capsule 100 having a continuous wall or envelope 10, such that the internal life supporting connection lines 40 are in communication with the external life supporting connection lines 41.

Figure 4:
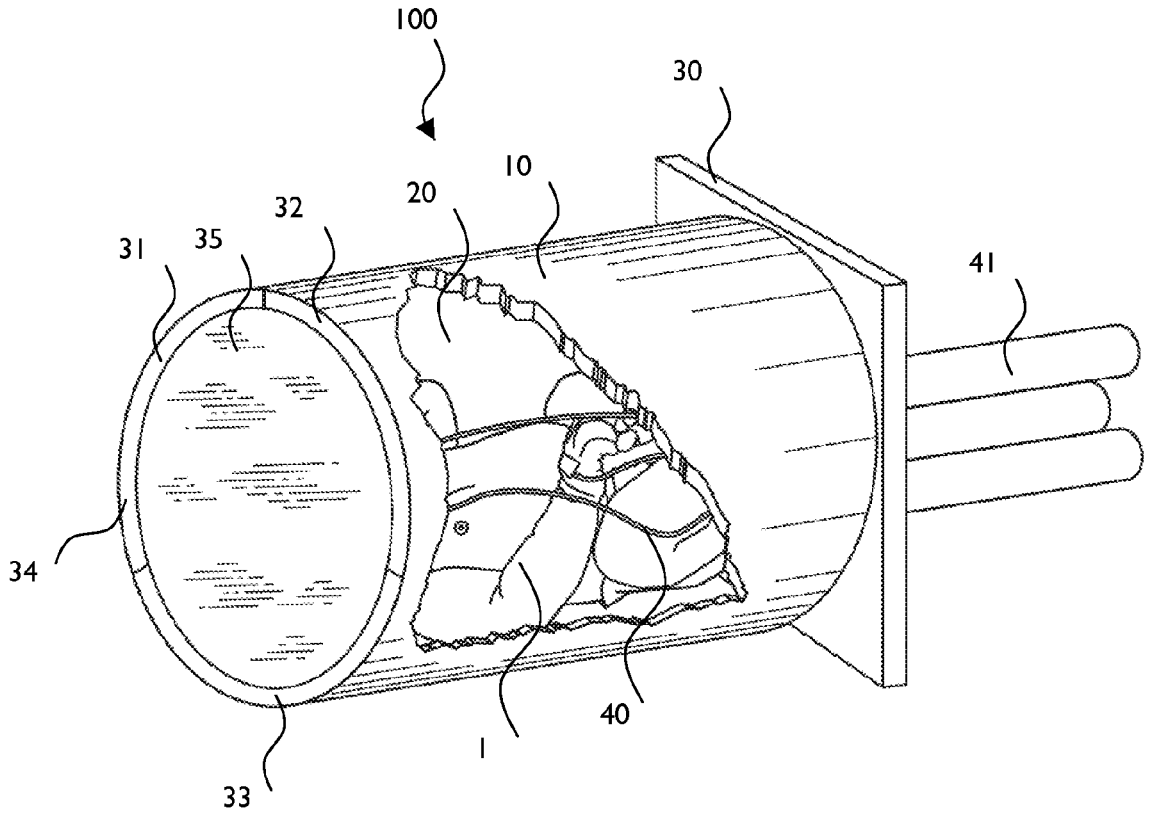
FIG. 4. is a schematic, not to scale illustration of a portable a cradle-like neonate support (CLNS), according to an embodiment of the present invention.

Reference is now made to FIG. 4, schematically illustrating in an out of scale manner a portable CLNS 100. According to the embodiment described above, the walls of air tight capsule 100 comprise a shell 10 constructed by four curved flaps 31-34, side walls 30 and 35. The encapsulated environment, i.e., confined volume 20 within the capsule is separated from the outside by shell 10, such that all life supporting connection lines 40 within the capsule are connected to the same outer life supporting connection lines 41. In this manner, transformation of chamber 10 from its OPEN configuration to its air tight CLOSED configuration is provided while the neonate 1 is continuously maintained connected to the at least one life supporting connection line. Dangerous exposure of the neonate to external environment is avoided. Endangering the patient by disconnection of the life supporting connection lines 40 is overcome.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A premature neonate closed life support system (NCLSS) suitable for transferring a neonate between an incubator and a medical device without decoupling the neonate from life supporting connection lines and without exposing the neonate to an external environment, the NCLSS comprising:

an air-tight incubator comprising a plurality of walls and one or more air-tight hand access ports in said walls; and a cradle-like neonate support (CLNS) removably placed within said incubator and having suitable dimensions and geometric-configuration for accommodating a premature neonate;

wherein said CLNS is adapted to couple said neonate to a life supporting system by means of at least one life supporting coupling line; and wherein said CLNS comprises a support configured to accommodate said neonate and a plurality of maneuverable curved flaps slidably connected to said support and configured to reversibly transform said CLNS between a first operational OPEN configuration, in which said flaps are slid beneath or aside said support, and a second operational air-tight CLOSED configuration, in which said flaps are closed, without opening said incubator and without removing said CLNS from said incubator; and wherein said support is further configured to allow positioning of the neonate on top of at least one of said plurality of maneuverable curved flaps; and thereby allowing transportation of said CLNS in said air-tight CLOSED configuration between said incubator and a medical device while the neonate is continuously maintained connected to said at least one life supporting coupling line and without exposing the neonate to the external environment.

2. The NCLSS according to claim 1, wherein said CLNS is constructed from magnetic field permeable materials and said medical device is a magnetic resonance device (MRD).

3. The NCLSS according to claim 2, wherein said at least one life supporting coupling line is selected from the group consisting of fluid-supply conduits, air-conditioning conduits, medication-supply conduits, excretion conduits, monitoring communication lines and any combination thereof.

4. The NCLSS according to claim 1, wherein said at least one life supporting coupling line is selected from the group consisting of fluid-supply conduits, air-conditioning conduits, medication-supply conduits, excretion conduits, monitoring communication lines and any combination thereof.

5. The NCLSS according to claim 4, wherein said fluid-supply conduits are selected from the group consisting of anesthetic gas, oxygen, life-rendering fluids, water, food supply, air and any combination thereof.

6. A method of transferring a premature neonate from an incubator to a medical device without disconnecting said neonate from a life supporting system and without exposing said neonate to external environment, the method comprising:

providing a premature neonate closed life support system (NCLSS) according to claim 1;

configuring said CLNS into said first operational OPEN configuration by sliding said maneuverable curved flaps beneath or aside said support;

placing said premature neonate in said CLNS, wherein the neonate is positioned on top of at least one of said plurality of maneuverable curved flaps;

coupling said neonate to said life supporting system by means of said at least one life supporting coupling line;

configuring said CLNS into said second operational air-tight CLOSED configuration without opening said incubator;

removing said CLNS from said incubator; and inserting said CLNS into said medical device for performing medical tests on said premature neonate.

7. The method according to claim 6, wherein said CLNS is constructed from materials permeable to magnetic fields.

8. The method according to claim 7, wherein said medical device is a magnetic resonance device (MRD).

9. The method according to claim 6, wherein said medical device is a magnetic resonance device (MRD).

* * * * *